US006219917B1

(12) United States Patent
Peed et al.

(10) Patent No.: US 6,219,917 B1
(45) Date of Patent: Apr. 24, 2001

(54) GAS SUPPLY DEVICE

(75) Inventors: Sherman D. Peed, Signal Mountain, TN (US); John Dipaolo, Mansfield, OH (US)

(73) Assignee: Universal Tubular Systems, Inc., Mansfield, OH (US)

( * ) Notice: Subject to any disclaimer, the term of this patent is extended or adjusted under 35 U.S.C. 154(b) by 0 days.

(21) Appl. No.: 09/383,448

(22) Filed: Aug. 26, 1999

Related U.S. Application Data

(62) Division of application No. 09/020,017, filed on Feb. 6, 1998, now Pat. No. 6,030,003.

(51) Int. Cl.[7] ..... B21D 51/16; B21D 53/00

(52) U.S. Cl. ..... 29/890.144; 29/890.14; 29/890.02

(58) Field of Search ..... 248/56; 285/61, 285/64, 148.19, 148.22, 205, 206, 353, 382.7; 29/890.02, 890.14, 890.144, 890.043; 126/39 E

(56) References Cited

U.S. PATENT DOCUMENTS

| | | | | |
|---|---|---|---|---|
| 877,849 | * | 1/1908 | Loebe | 285/311 |
| 1,074,789 | * | 10/1913 | Green | 126/39 R |
| 1,354,419 | * | 9/1920 | Reppetto | 285/148.12 |
| 1,445,984 | * | 2/1923 | Wilkinson | 126/39 E |
| 1,656,447 | * | 1/1928 | Schenk | 126/39 J |
| 2,033,369 | * | 3/1936 | Baker | 126/39 N |
| 2,109,399 | * | 2/1938 | Meacham et al. | 431/48 |
| 2,763,960 | * | 9/1956 | Wintriss | 446/184 |
| 3,195,561 | | 7/1965 | Sovitzky | 285/61 X |
| 3,254,399 | * | 6/1966 | Zahuranec | 29/407.09 |
| 3,413,017 | | 11/1968 | Hughey | 285/148.22 X |
| 3,930,298 | | 1/1976 | Ridenour . | |
| 3,977,710 | | 8/1976 | Ridenour . | |
| 4,076,281 | | 2/1978 | Davis . | |
| 4,126,929 | | 11/1978 | Ridenour . | |
| 4,313,286 | | 2/1982 | Harbeke . | |
| 4,409,954 | * | 10/1983 | Berlik et al. | 126/39 M |
| 4,547,942 | | 10/1985 | Fukuda | 285/382.7 X |
| 4,572,154 | * | 2/1986 | Schweitzer | 126/39 E |
| 4,739,596 | | 4/1988 | Cunningham et al. . | |
| 4,860,791 | | 8/1989 | Putnam . | |
| 4,871,199 | | 10/1989 | Ridenour et al. . | |
| 5,031,940 | | 7/1991 | Stefanos . | |
| 5,222,768 | | 6/1993 | Hofer et al. . | |
| 5,316,346 | | 5/1994 | Maurer | 285/61 X |
| 5,362,111 | | 11/1994 | Harbin . | |
| 5,573,285 | * | 11/1996 | Ridenour | 285/353 |
| 5,588,681 | | 12/1996 | Parks . | |
| 5,829,425 | | 11/1998 | Woods et al. . | |
| 5,833,280 | | 11/1998 | Ferlin et al. . | |
| 5,836,296 | | 11/1998 | Hillis et al. . | |

* cited by examiner

*Primary Examiner*—S. Thomas Hughes
*Assistant Examiner*—Marc Jimenez
(74) *Attorney, Agent, or Firm*—Pearne & Gordon LLP

(57) ABSTRACT

A method of assembling a gas supply device within an appliance cabinet is disclosed. The method comprises bending a tube assembly prior to installation in the appliance, attaching a fitting to the first end of the tube, attaching the fitting of the first end of the tube to a burner assembly, attaching a second fitting having a non-circular portion to the second end of the tube, attaching a mounting bracket with a non-circular profile to the non-circular portion of the second fitting in a fixed condition to prevent rotation of the body with respect to the bracket, and mounting the tube assembly in the appliance cabinet.

10 Claims, 2 Drawing Sheets

GAS SUPPLY DEVICE

This Application is a Division of Ser. No. 09/020,017 filed Feb. 6, 1998, U.S. Pat. No. 6,030,003.

BACKGROUND OF THE INVENTION

The present invention generally relates to a gas supply assembly for an appliance powered by natural gas. The invention also provides a method of assembling the appliance.

Many domestic appliances are powered, at least in part, by natural gas. This necessitates that the appliance be provided with a gas supply assembly for connecting the appliance to an external gas supply line and for feeding the incoming natural gas to a burner assembly.

Various improvements of gas supply assemblies have been made through the years. These improvements include the use of a double-bead fitting such as found in U.S. Pat. Nos. 4,871,199 issued Oct. 3, 1989 and 5,573,285 issued Nov. 12, 1996, which are each incorporated herein by reference. Another improvement is the use of a stake joint to join a gas carrying tube with a fitting component. Examples of stake joints are found in U.S. Pat. Nos. 3,930,298 issued Jan. 6, 1976, 3,977,710 issued Aug. 31, 1976 and 4,126,929 issued Nov. 28, 1978, each of which are incorporated herein by reference. Double-bead fittings and stake joints have helped to reduce the number of parts required by the appliance, and reduced the number of steps required to assemble the appliance.

Despite these improvements, however, there exists a need in the art of appliance manufacturing to further improve the gas supply assembly and the method of assembling the appliances. It has been found that during installation, excessive torque is often placed on parts comprising the gas supply assembly. This excessive torque commonly results in fractured parts or separated joints which would allow the leakage of natural gas. Obviously, this condition is unacceptable and must be corrected before completing the assembly process. Repairing or replacing damaged parts, however, increases both the total cost and assembly time of the appliances.

In addition, the installation process of a gas supply assembly into the appliance is lengthy and difficult. A number of factors contribute to this problem. These factors include the lack of space within the appliance to manipulate parts and tools, the difficulty in positioning the gas supply assembly around other appliance subsystems, and the difficulty in holding one end of gas supply assembly while securing the other. These difficulties also increase the total cost of the appliance.

The present invention overcomes at least some of the above-noted disadvantages of the related art by providing a gas supply assembly for an appliance that makes the assembling process easier and faster while minimizing the number of damaged parts. This is accomplished by providing a preshaped gas supply assembly that has interlocking components to support and prevent the rotation of the assembly during installation. The gas supply assembly can be attached to a burner assembly outside of the appliance where manipulation of the parts is simple. The gas supply assembly is constructed of lightweight parts that assist in reducing the overall weight and shipping cost of the appliance.

BRIEF SUMMARY OF THE INVENTION

According to the present invention, a gas supply assembly for an appliance includes a tube with a first end and a second end. The tube is preshaped to fit around appliance subsystems, thus enhancing the installation of the gas supply assembly in the appliance. The first end is provided with a first fitting and the second end is provided with a second fitting, the second fitting having a second fitting shape. The assembly also has a mounting bracket defining a bracket opening for receiving the second fitting. The bracket opening has a shape complementary to that of the second fitting shape so that the mounting bracket and the second fitting cooperate to substantially prohibit rotation of the tube.

The present invention also provides a method of assembling an appliance having a cabinet. A tube assembly includes a preformed tube shaped to fit around objects in the cabinet, first fitting at a first end of the tube and a second fitting at a second end of the tube. The tube assembly is attached to a burner assembly using the first fitting. The tube assembly and the attached burner assembly are then inserted into the cabinet so that a first portion of the second fitting extends through an opening defined by the cabinet. The burner assembly is then secured within the cabinet.

The present invention also provides a method of assembling a gas supply device. A tube, having a first end and a second end, is bent into a shape which enhances installation of the device in an appliance. A first fitting is attached to the first end of the tube. A second fitting, defining a second fitting shape, is attached to the second end of the tube. A mounting bracket is provided for attaching the device to a cabinet. The mounting bracket defines a bracket opening for receiving the second fitting. The bracket opening has a shape complementary to that of the second fitting shape. The mounting bracket is placed on the second fitting so that the second fitting shape and the bracket opening shape cooperate to substantially prohibit rotation of the tube relative to the second fitting. The cabinet is provided with a receptor for receiving the mounting bracket and preventing rotation of the mounting bracket. Therefore, rotation of the device as a whole is prevented to avoid damage to the device.

BRIEF DESCRIPTION OF THE SEVERAL VIEWS OF THE DRAWING

These and further features of the present invention will be apparent with reference to the following description and drawings, wherein.

DETAILED DESCRIPTION OF THE INVENTION

Figure 1:
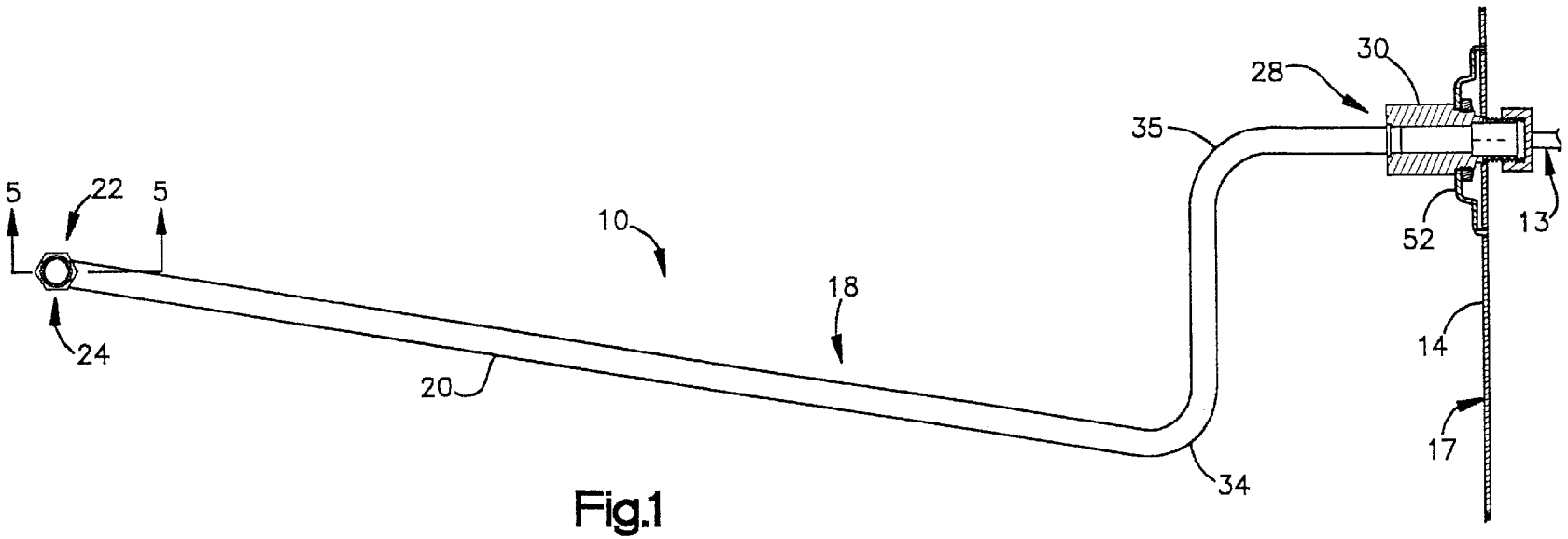
FIG. 1 is a partial cross sectional view of a gas supply assembly according to the present invention.

In the detailed description which follows, identical components have been given the same reference numerals, and, in order to clearly and concisely illustrate present invention, certain features may be shown in somewhat schematic form.

Figure 2:
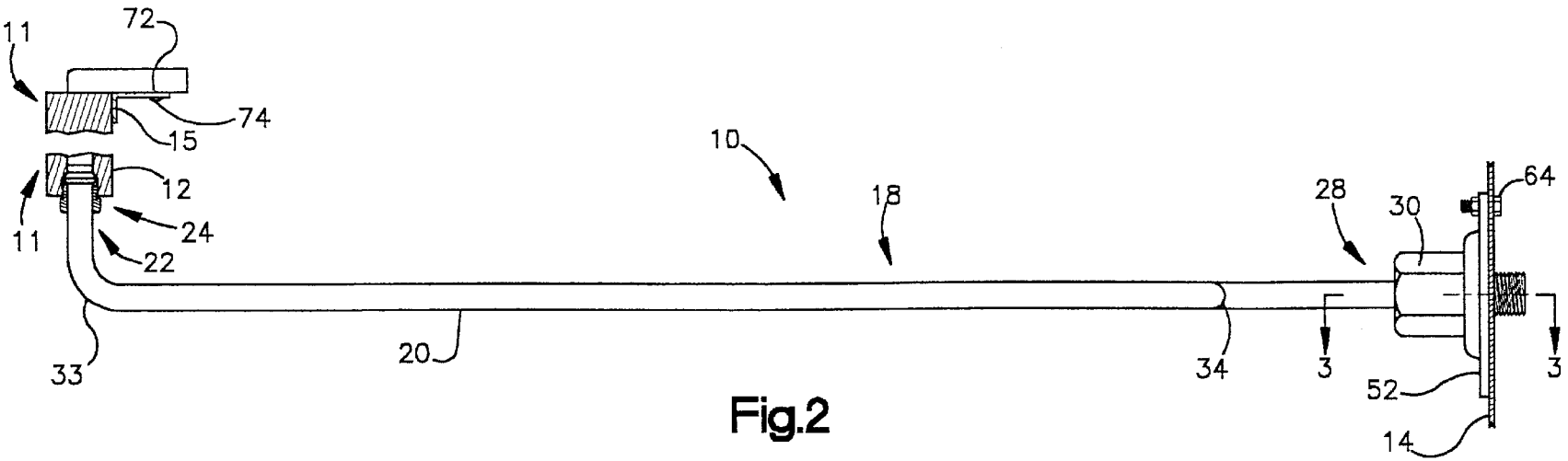
FIG. 2 is a partial cross sectional view of the gas supply assembly of FIG. 1 rotated 90 degrees.
Figure 5:
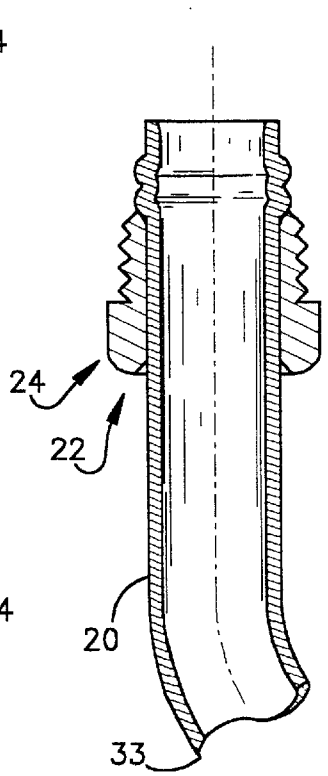
FIG. 5 is a cross sectional view along the line 5—5 in FIG. 1.

Referring to FIGS. 1 and 2, the present invention provides a gas supply assembly 10 for a gas powered appliance. The illustrated appliance is a clothes dryer, but other types of gas powered appliances are within the scope of the present invention. The gas supply assembly 10 connects a burner assembly 11 that consumes natural gas to an external gas supply line 13. The burner assembly 11 includes a tube manifold 12 and other components such as a gas valve, a gas burner, an igniter and a burner mounting bracket 15.

Figure 3:
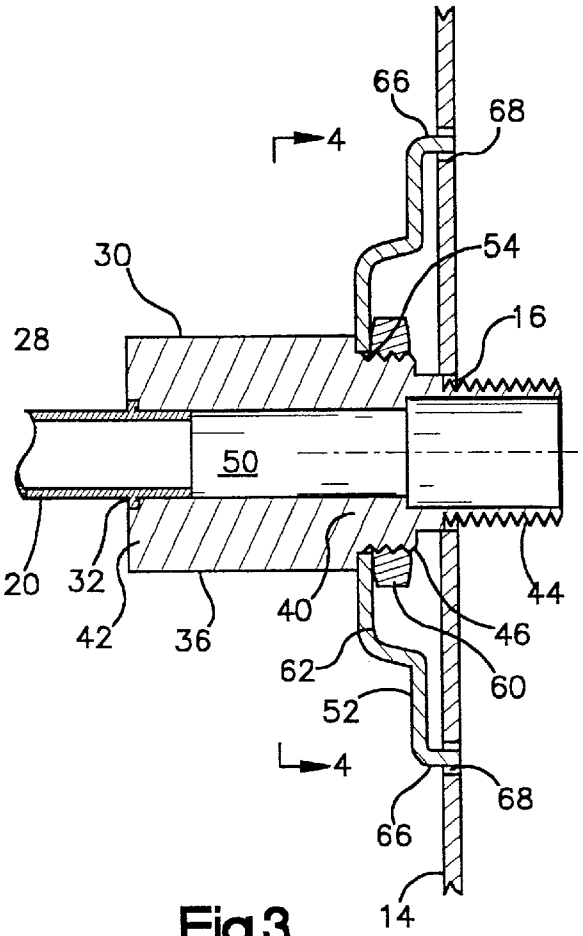
FIG. 3 is a cross sectional view along the line 3—3 in FIG. 2.

The appliance includes a cabinet 17 having at least one cabinet wall 14. The cabinet wall 14 is provided with an opening 16 (FIG. 3) and, as will be discussed in greater detail below, a part of the gas supply assembly 10 extends through the cabinet opening 16 (FIG. 3).

The gas supply assembly 10 includes a tube assembly 18 and a mounting bracket 52. The tube assembly includes a tube 20, a first or burner fitting 24 and a second or inlet fitting 30. The tube assembly 18 parts are preferably made of lightweight nonferrous material, such as aluminum, but can be any other suitable material such as steel. Such a tube 20 is resilient, but is also easily bent into a desired shape and is flexible so that it will yield slightly during installation. This makes manipulation of the gas supply assembly 10 relatively effortless when the components are positioned and secured in the appliance. The tube 20 is fabricated with a series of bends 33, 34, and 35 in predetermined locations and with predetermined angles. The bends 33, 34 and 35 are provided to allow the gas supply assembly 10 to extend through the interior of the appliance from the gas supply line 13 to the burner assembly 11. Some bends 33, 34 and 35 may also be required to guide the tube around other components in the appliance. While the illustrated tube has 3 bends, other quantities, locations, and/or angles may be necessary for other appliances.

The tube 20 has a first end 22 provided with the burner fitting 24. The burner fitting 24 is preferably a double-bead fitting, but can be other suitable types of fittings. U.S. Pat. Nos. 4,871,199 issued Oct. 3, 1989 and 5,573,285 issued Nov. 12, 1996 both disclose double-bead type fittings and are incorporated herein by reference. The burner fitting 24 engages the burner assembly 11 via the tube manifold 12, as best shown in FIG. 2.

The tube 20 has a second end 28 provided with the inlet fitting 30. The inlet fitting 30 is also made out of lightweight nonferrous material, such as aluminum, but can be any other suitable material. This type of material makes the inlet fitting 30 easy to machine and manufacture, resulting in an economical product. The inlet fitting 30 is preferably joined to the tube 20 using a stake joint 32 (FIG. 3), but can be joined by any suitable joint. Examples of stake joints 32 are disclosed in U.S. Pat. Nos. 3,930,298 issued Jan. 6, 1976, 3,977,710 issued Aug. 31, 1976 and 4,126,929 issued Nov. 28, 1978, all of which are incorporated herein by reference.

Referring to FIG. 3, the inlet fitting 30 is shown in cross section. The inlet fitting 30 is provided with a body portion 36. The body portion 36 is preferably shaped so that it may be grasped by a wrench. For example, a hex-shaped body portion 36 will suffice. The inlet fitting 30 has a front 40 at one end and a back 42 at the other end. Extending from the front 40 is a first threaded portion 44 and a second threaded portion 46. The first threaded portion 44 is sized for connection to the gas supply line 13 (FIG. 1).

The inlet fitting 30 defines a passageway 50 extending from the front 40 to the back 42. The tube 20, which is preferably joined to the back of the inlet fitting 30, communicates with the passageway 50 so that natural gas may flow from the gas supply line, through the inlet fitting 30, through the tube 20, to the burner assembly 11. As one skilled in the art will appreciate, the tube 20 may alternatively be joined to a side of the inlet fitting 30 and communicate with a passageway 50 originating in the front 40 of the inlet fitting 30, turning in the inlet fitting 30 and terminating in the side of the inlet fitting 30 where the tube 20 is connected to the inlet fitting 30.

Figure 4:
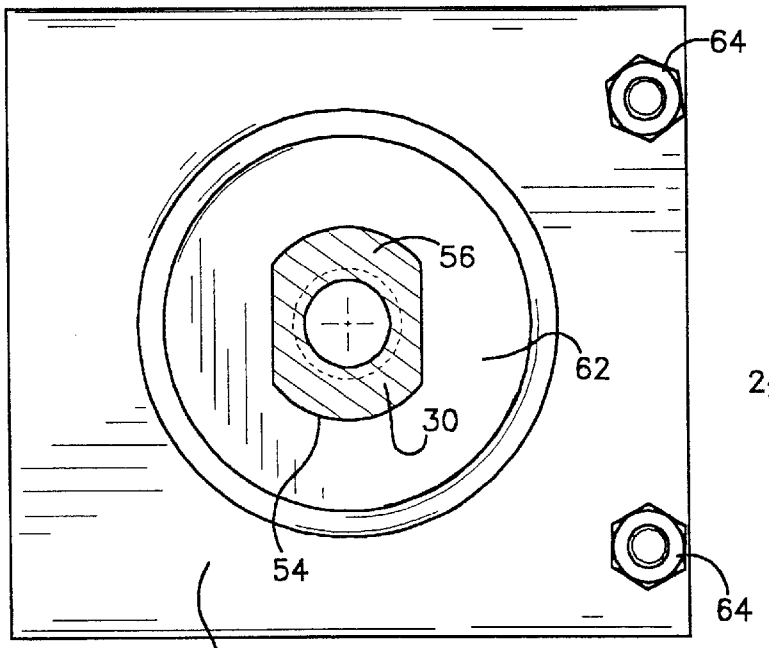
FIG. 4 is a cross sectional view along the line 4—4 in FIG. 3.

With reference to FIGS. 3 and 4, the mounting bracket 52 defines a bracket opening 54. The bracket opening 54 is sized and shaped to receive the inlet fitting 30 so that the mounting bracket 52 cooperates with a complimentary inlet fitting shape 56. In this manner, the mounting bracket 52 and the inlet fitting 30 cooperate so as to minimize rotation of the tube 20. The interaction between the mounting bracket 52 and the inlet fitting 30 also serves to support the tube 20 within the appliance. The inlet fitting shape 56 is preferably defined by the outer surface of the second threaded portion 46, but may be defined by the body portion 36 or the first threaded portion 44 with equivalent results. Once received by the mounting bracket 52, the inlet fitting 30 is secured to the mounting bracket 52. In the preferred embodiment, this is accomplished by threadably engaging a nut 60 on the second threaded portion 46. The mounting bracket 52 is provided with a recess 62 in the area around the bracket opening 54. The recess 62 accommodates the nut 60 allowing the mounting bracket 52 to be secured flush with the cabinet wall 14.

In order to be secured to the cabinet wall 14, the mounting bracket 52 and the cabinet wall 14 are provided with at least one screw hole. A screw 64, or equivalently a bolt and nut combination, is used in conjunction with the screw hole to secure the mounting bracket 52 to the cabinet wall 14 (FIGS. 2 and 4). For enhanced aligning and securing capability, the mounting bracket 52 may be provided with projections 66, preferably in the form of ridges along edges of the mounting bracket 52. To receive the projections 66, the cabinet wall 14 is provided with receptors 68. The receptors 68 are preferably in the form of slots for receiving the ridges. The projections 66 and receptors 68 cooperate to align the mounting bracket 52 and help to retain the mounting bracket 52 in position. With the use of projections 66 and receptors 68, the use of screws 64 to secure the mounting bracket 52 becomes optional. This is because the resiliency of the components, namely the tube 20 and the inlet fitting 30, will hold the mounting bracket 52 in place once the burner assembly is secured within the appliance. One skilled in the art will appreciate that receptors 68 may be integrally formed with the cabinet wall 14 or on a separate receptor plate (not shown) that is secured to the cabinet wall.

An appliance incorporating the gas supply assembly 10 according to the present invention may be assembled in an easy and time efficient manner. Two alternative assembly methods are contemplated.

The first assembly method begins with attaching the tube assembly 18 to the burner assembly 11 by securing the burner fitting 24 to the burner manifold 12. This step is preferably performed outside the appliance cabinet 17 where the parts are easily manipulated. Then, the mounting bracket 52 is placed on the inlet fitting 30 so that the inlet fitting shape 56 is in cooperation with the bracket opening 54. The mounting bracket 52 is then secured to the inlet fitting 30 using the nut 60. Next, the tube assembly 18, with the attached burner assembly 11 and mounting bracket 52, is inserted into the cabinet 17 so that the first threaded portion 44 extends through the cabinet opening 16 and the burner mounting bracket 15 is adjacent a receiving point 72. Once the components are inserted and positioned in the appliance, the burner assembly 11 is secured within the appliance by attaching the burner mounting bracket 15 to the receiving point with screws 74 or the like. Finally, the mounting bracket 52 is secured to the cabinet wall 14 with the screw(s) 64 or aligning the projections 66 to be received by the receptors 68, or both. It should be noted that the projections 66 and the receptors 68 may already be aligned as a result of the inserting and positioning procedure. It should also be noted that the order of many of the steps may be changed. For example, the mounting bracket 52 may be secured to the inlet fitting 30 before the burner assembly 11 is secured to the tube assembly 18.

The second assembly method also begins with attaching the tube assembly 18 to the burner assembly 11 by securing the burner fitting 24 to the burner manifold 12. This step is preferably performed outside the appliance cabinet 17 where the parts are easily manipulated. Next, the mounting bracket 52 is secured to the cabinet wall 14 using the screw(s) 64 so that the bracket opening 54 is aligned with and adjacent the cabinet opening 16. At this point, the projections 66 should be engaged in the receptors 68, if the embodiment using the projections 66 and receptors 68 is selected. It should be noted that the step of attaching the tube assembly 18 to the burner assembly 11 and the step of securing the mounting bracket 52 may be conducted in an opposite order with equivalent results. Next, the tube assembly 18, with the attached burner assembly 11, is inserted into the cabinet 17 so that the first threaded portion 44 extends through the cabinet opening 16, the inlet fitting shape 56 is in cooperation with the bracket opening 54, and the burner mounting bracket is adjacent the receiving point 72. Once the components are inserted and positioned in the appliance, the burner assembly is secured within the appliance by attaching the burner mounting bracket 15 to the receiving point with screws 74 or the like. Finally, the mounting bracket 52 is secured to the inlet fitting 30 by passing the nut 60 over the first threaded portion 44 and through the cabinet opening 16, then by threadably engaging the nut 60 on the second threaded portion 46. Should this assembly method embodiment be employed, the cabinet opening 16 must be large enough to accommodate the nut 60 and a tool to tighten the but 60. One skilled in the art will appreciate that the order of many of the foregoing steps may be changed with equivalent results.

For a number of reasons, both of these methods greatly assist in making the assembly of the appliance easy and economical. A major reason is that the components are assembled in locations where working on the parts is simple. For example, the tube assembly 18 is attached to the burner assembly 11 outside the appliance cabinet 17 rather than inside the cabinet 17 where space is limited and manipulation of the parts and tools is difficult. Another reason is that before the inlet fitting 30 and mounting bracket 52, and the mounting bracket 52 and cabinet wall 14, are permanently secured, they all lock together with cooperating shapes as to support and prevent rotation of the tube assembly while the burner assembly 11 is being secured. Once the burner assembly 11 is secured, the remaining parts may be secured with little effort. Another reason is that the selection of the tube 20 material adds flexibility to the gas supply assembly 18. This allows for the easy manipulation of the components during the positioning and securing of the burner assembly 11 and inlet fitting 30/mounting bracket 52 combination.

Although particular embodiments of the invention have been described in detail, it is understood that the invention is not limited correspondingly in scope, but includes all changes and modifications coming within the spirit and terms of the claims appended hereto.

What is claimed is:

1. A method of assembling an appliance having a cabinet, comprising the steps of:

attaching a tube assembly having a tube with a preformed shape to fit around objects disposed in the appliance, a first fitting at a first end of the tube, and a second fitting at a second end of the tube the second fitting having a non-circular portion, to a burner assembly using the first fitting;

providing a mounting bracket, the mounting bracket defining a non-circular shaped bracket opening, the bracket opening being adapted to receive a complimentary non-circular portion of the second fitting, to prohibit substantial rotation of the second fitting to the shaped bracket opening during assembly;

fastening the second fitting to the mounting bracket in a fixed condition to prohibit substantial relative axial movement between the second fitting and the bracket regardless of whether the second fitting is attached further, thereby providing a combination tube assembly/bracket assembled in a fixed condition;

inserting the combination tube assembly/bracket and the attached burner assembly into the cabinet so that the second fitting extends through an opening defined by the cabinet;

securing the mounting bracket to the cabinet; and securing the burner assembly within the cabinet.

2. The method according to claim 1, wherein the step of attaching the tube assembly to the burner assembly is performed outside the cabinet, before the step of inserting the tube assembly into the cabinet.

3. The method according to claim 1 further comprising the step of providing the cabinet with a receptor for receiving the mounting bracket and preventing rotation of the mounting bracket and the device as a whole thereby avoiding damage to the device.

4. The method according to claim 3, wherein the step of providing a mounting bracket includes forming a projection for engaging the receptor.

5. The method according to claim 4, wherein the projection is a ridge and the receptor is a slot.

6. The method according to claim 1, further comprising the step of providing the first fitting with a double-bead used to attach a gas supply device to the burner assembly.

7. The method according to claim 1, further comprising the step of providing the second fitting with a first threaded portion and a second threaded portion.

8. The method according to claim 7, further comprising the steps of sizing the first threaded portion for connection to a gas supply line and shaping the second threaded portion to define the second fitting shape.

9. The method according to claim 1, further comprising the step of securing the mounting bracket to the second fitting with a nut.

10. A method of assembling a gas supply device comprising the steps of:

bending a tube into a shape to enhance installation of the device in an appliance, the tube having a first and a second end;

attaching a first fitting to the first end of the tube;

providing the first fitting with a double-bead to attach the gas supply device to a burner assembly;

attaching a second fitting to the second end of the tube, the second fitting defining a second fitting shape having a non-circular portion;

providing the second fitting with a first threaded portion and a second threaded portion;

sizing the first threaded portion for connection to a gas supply line;

providing a mounting bracket for attaching the device to a cabinet, the mounting bracket defining a non-circular shaped bracket opening for receiving the complimentary non-circular portion of the second fitting so that the non-circular portion of the second fitting and the non-circular bracket opening cooperate to prohibit substantial rotation of the body of the second fitting to the shaped bracket; and fastening the mounting bracket to the second fitting in a fixed condition to prohibit substantial relative axial movement between the second fitting and the bracket regardless of whether the second fitting is attached further thereby providing a combination tube assembly/bracket assembled in a fixed condition which may be readily inserted into a cabinet.

* * * * *